United States Patent [19]

Abel

[11] 4,022,642

[45] May 10, 1977

[54] YARN FOLDING MECHANISM

[75] Inventor: Martin L. Abel, Franklin, Mich.

[73] Assignee: Permalock Company, Inc., Auburn Heights, Mich.

[22] Filed: Feb. 18, 1975

[21] Appl. No.: 550,633

Related U.S. Application Data

[62] Division of Ser. No. 323,440, Jan. 15, 1973, Pat. No. 3,915,789.

[52] U.S. Cl. ..... 156/72; 28/2; 28/72 NW; 254/134.3 R; 270/79

[51] Int. Cl.[2] ..... B04H 11/04

[58] Field of Search ..... 156/72, 435, 179, 205, 156/210, 324, 368, 439, 440, 471, 535, 553, 65, 66, 434; 74/56, 112; 226/113, 120; 227/19, 20; 254/134.3 R; 270/61 F, 79; 425/303, 343, 369, 336; 264/286; 15/195, 199; 197/168; 28/1 CL, 2, 72 P, 72 NW

[56] References Cited

UNITED STATES PATENTS

| | | | |
|---|---|---|---|
| 2,348,433 | 5/1944 | Guerci | 425/303 |
| 2,685,357 | 8/1954 | Koreska | 197/168 |
| 2,874,408 | 2/1959 | Vieli et al. | 156/474 |
| 3,127,293 | 3/1964 | Trenteseaux | 156/72 |
| 3,411,966 | 11/1968 | Couquet | 156/72 |
| 3,531,343 | 9/1970 | Couquet | 156/72 |
| 3,627,306 | 12/1971 | Affupper | 270/79 |
| 3,657,052 | 4/1972 | Debonnet | 156/72 |
| 3,790,426 | 2/1974 | Bylund | 156/436 |

*Primary Examiner*—Charles E. Van Horn
*Assistant Examiner*—John E. Kittle
*Attorney, Agent, or Firm*—Lane, Aitken, Dunner & Ziems

[57] ABSTRACT

The yarn folding mechanism includes a pair of wires extended across a plurality of strands of yarn between two opposing surfaces, the wires being connected at each end to a rotationally movable member capable of moving the wires along separate, concentric, orbital paths. The orbital movement at the ends of the wires is translated into linear movement where the wires engage and fold the yarn by a cam surface that engages and guides the wires along their separate linear paths. The wires are connected at their ends to a coil spring so that the length of the wire between the members can vary, all the time maintaining a minimum tension in the wires. Each member is rotated by a reversible stepping motor that is programmed to move its wire along a predetermined orbital path.

26 Claims, 25 Drawing Figures

YARN FOLDING MECHANISM

This is a division of application Ser. No. 323,440 filed Jan. 15, 1973, now U.S. Pat. No. 3.915,789.

BACKGROUND OF THE INVENTION

This invention relates to machines for making nonwoven bonded carpeting and, more particularly, to the portion of such a machine that folds the yarn from which the pile is formed and either plants the yarn in the bonding material in which it is anchored or arranges the yarn so that the bonding material can be applied later.

Machines have been developed for making carpeting by folding a number of strands of yarn in row simultaneously and planting them in a layer of adhesive spread across the surface of a sheet of backing material, and then repeating the operation on an opposing parallel sheet of backing material. This is done to form a series of accordion-type loops from each strand of yarn between the backing layers. After the adhesive has been cured, the loops are severed midway between the backing layers to form two separate carpets.

Another type of machine has been developed in which the loops of yarn are formed initially without bonding them to the backing layers, and the adhesive is applied later to the yarn. In both types of machines the adhesive can be used as the backing layer in addition to being the means for anchoring the yarn in place.

When a backing marterial is used, it is normally formed of woven strands of jute, although there are many other suitable types of backing material. The bonding material can be an adhesive such as a liquid synthetic resin which has been applied to the backing sheets or directly to the yarn. Polyvinylchloride (PVC) has been found to be effective.

A number of different types of mechanisms have been developed for embedding the yarn into bonding material. As taught by U.S. Pat. No. 3,531,343 to Couquet, individual strands of yarn can be planted one-by-one into an advancing sheet of backing material coated with an adhesive. The lower end of each strand is clamped and cut the the desired length. The severed portion is then lowered by the clamping apparatus and planted into the adhesive. This system for manufacturing nonwoven carpeting is disadavantageous for several reasons. First, because each individual strand has to be clamped, severed and lowered into place, much time is wasted by separately performing each one of these steps. In addition, because of the space taken up by the clamping mechanism and other elements used in the planting process, there is a physical limitation upon the number of strands that can be planted per square inch, thereby limiting the gauge of the carpet pile.

Several machines have been developed which use blade-like members that extend across the entire width of the sheet of backing material for folding the strands of yarn and pushing them into an adhesive layer. One such machine is shown in U.S. Pat. No. 3,127,293 to Trenteseaux, which provides a blade and a series of superimposed plates for alternately urging the strands of yarn against adhesive that is coated on a pair of packing strips at a point near the top of the well into which the backing layers are advanced. A pair of metal foils is provided for cooperating with the blade and plates so that the strands of yarn are folded in a way to prevent an excessive length of the yarns from becoming embedded in the adhesive layer. However, problems arose with this machine because it proved to be to slow since each member that presses against the strands of yarn must be completely withdrawn before the other member can be moved into place to form the next loops of accordion-type chains. In addition, the operation of the machine is such that the members tended to become coated with the adhesive and had to be cleaned periodically, thereby necessitating closing down the machine and stopping production.

Some of these problems were apparently solved by the machine in U.S. Pat. No. 3,657,052 to Debonnet, where a different mechanism that includes a pair of blades is porvided for folding and planting the yarn. Each blade operates to hold the yarn in position in the adhesive for a short time while the second blade moves toward its bonding position so that the yarns will not be pulled out of the adhesive. This delaying action is accomplished by means of cam surfaces which operate to retract the blades along paths different from those along which they were advanced. However, although this mechanism is an apparent improvement over the one in the Trenteseaux patent, the blade that holds the planted yarns in place is not delayed long enogh, which results in some of the yarns being pulled out of the adhesive during the next planting step. In addition, the blades and their movement require highly complex equipment that includes a number of heavy, expensive and space-consuming components. Much energy is required to operate the machine which is extremely expensive to manufacture and operate. Because of the large number of moving parts and their relatively large size, the machine is limited in its operational speed.

SUMMARY OF THE INVENTION

In accordance with the invention, a mechanism for folding and planting strands of yarn is provided which solves the problems discussed above.

In place of the heavy, bulky blades used in prior art devices, a pair of tensioned wires are manipulated to fold and plant the strands of yarn. The wires extend across the strands of yarn and are connected at their corresponding ends to a pair of rotatably movable wire holders, one nested within the other so that the wires can be moved independent of each other along separate, concentric, orbital paths. A cam plate is located between the wire holders and the yarn, the plate including a rectangular opening defined by a cam surface that the wires engage for translating the orbital movement of the portions of the wires connected to the wire holders to linear movement to effect the folding and planting of the strands of yarn.

The wire holders are rotated by means of a pair of conventional, reversible stepping motors that are programmed to operate in accordance withe the sequence that will be described in detail below.

By providing a pair of wires instead of the blades, all of the bulky mechanical components located above the blades to move them are eliminated. Since the wires are much lighter than the blades, they are much more responsive to movement and can fold and plant the yarns much quicker than the prior art devices. The path along which each wire moves can be set so that the planted yarns are hold in place by the wires longer than in prior art machines. The movement of the wires can be controlled precisely enough that the yarns can be planted sufficiently without the wires themselves contacting the adhesive.

In addition, because must less energy is consumed due to the lightweight nature of the wires and the mechanism for moving them, operating costs are sinificantly reduced. Because of the much simpler moving mechanism, the carpet making machine is significantly less expensive to manufacture and easier to maintain and repair after put into operation.

BRIEF DESCRIPTION OF THE DRAWINGS

For a better understanding of the invention, reference may be had to the following description of an exemplary embodiment of the invention taken in conjunction with the accompanying drawings in which.

DETAILED DESCRIPTION OF AN EXEMPLARY EMBODIMENT

Figure 1:
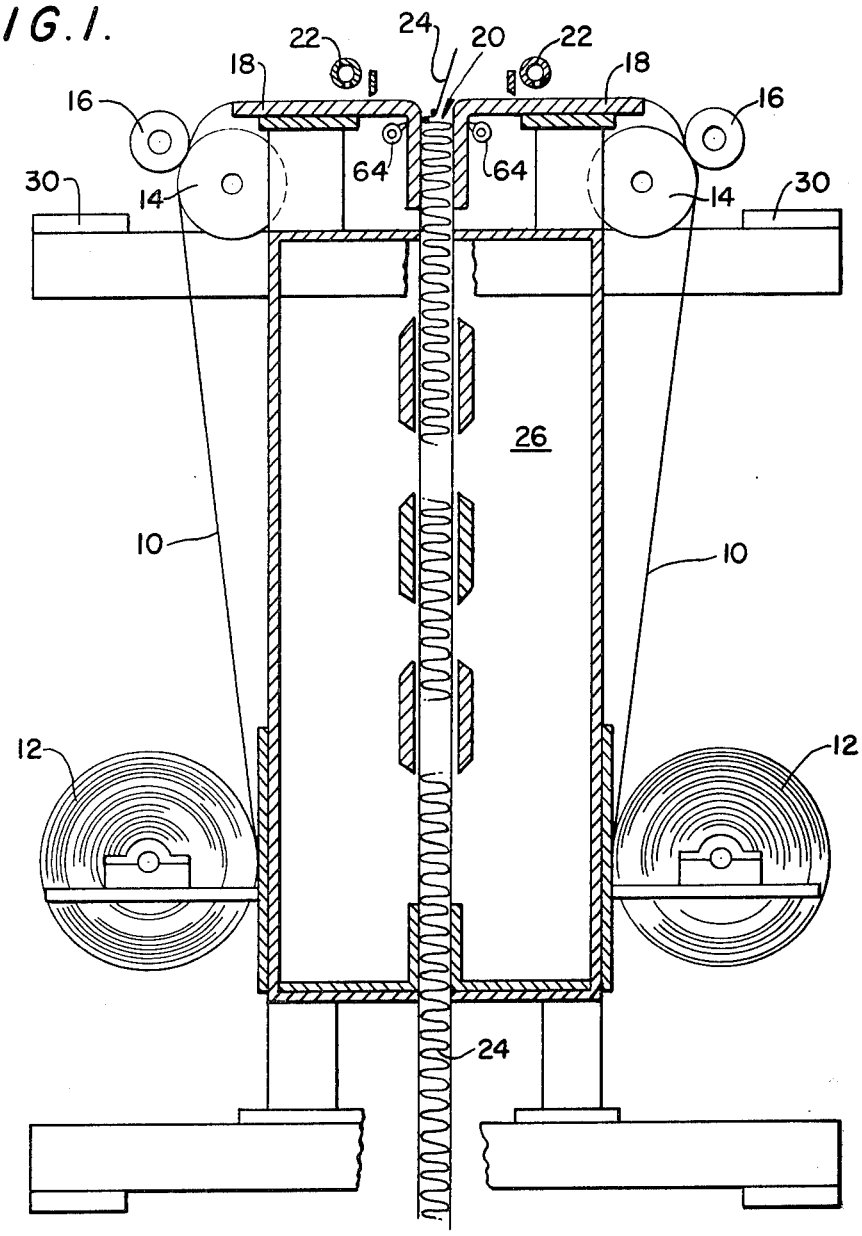
FIG. 1 is a front view, partially in section, of the portion of the carpet making machine where the layers of backing material are advanced and coated with adhesive, the yarn is folded and planted in the adhesive and the adhesive is cured.

An exemplary embodiment of the yarn folding mechanism will now be described in conjunction with the type of machine for making nonwoven carpeting that is the subject of my co-pending application Ser. No. 315,845, filed Dec. 18, 1972, now abandoned. This machine, as shown in FIG. 1, continuously advances two layers of backing material 10, which are unwound from the rolls 12. The backing layers 10 are advanced by driving roller 14 and the pressure roller 16. Adjustable stepping motors (not shown) are used to drive the pressure rollers 16 so that the layers of backing material 10 are advanced in step-like fashion for reasons which will become apparent below. The stepping motors are synchronized with each other so that both layers of backing material 10 will be advanced at exactly the same speed and between the same intervals.

The rollers 14, 16, advance the layers of backing material 10 across the guides 18 which includes a flat horizontal surface integral with a flat vertical surface, the vertical surfaces facing each other to form a well 20 between them. As the layers of backing material 10 move across the horizontal surfaces of the guides 18, a layer of adhesive such as polyvinylchloride (PVC) is applied to the outer surfaces of the layers 10. The PVC can be applied directly from a reservoir (not shown), a plurality of nozzles (not shown) or a perforated tube 22 which extends across the entire with of the layers of backing material 10. This latter means for applying the PVC is described in greater detail in my co-pending application mentioned above.

As the layers of the backing material 10 coated with the PVC advance into the well 20, the strands of yarn 24 extending in a row across the width of the backing layers 10 are bonded in accordion-like fashion between the opposing layers of backing material 10. The mechanism which performs the folding and planting operation prior to bonding is the subject of this invention and will be described in detail below. After the layers of backing material 10 have been connected by the accordion-like chains of yarn, they move into an oven 26 where heat is applied by any suitable heating means (not shown) for curing the PVC and anchoring the yarn 24 in place. The connected layers of backing material 10 then move out of the oven 26 to a cutter (not shown) which severs the yarn 24 between the backing material 10 to fom two separate carpets.

Alternatively, the mechanism can be used just to fold the strands of yarn to form the plurality of accordion-like chains, the PVC or other adhesive being applied later.

Figure 2:
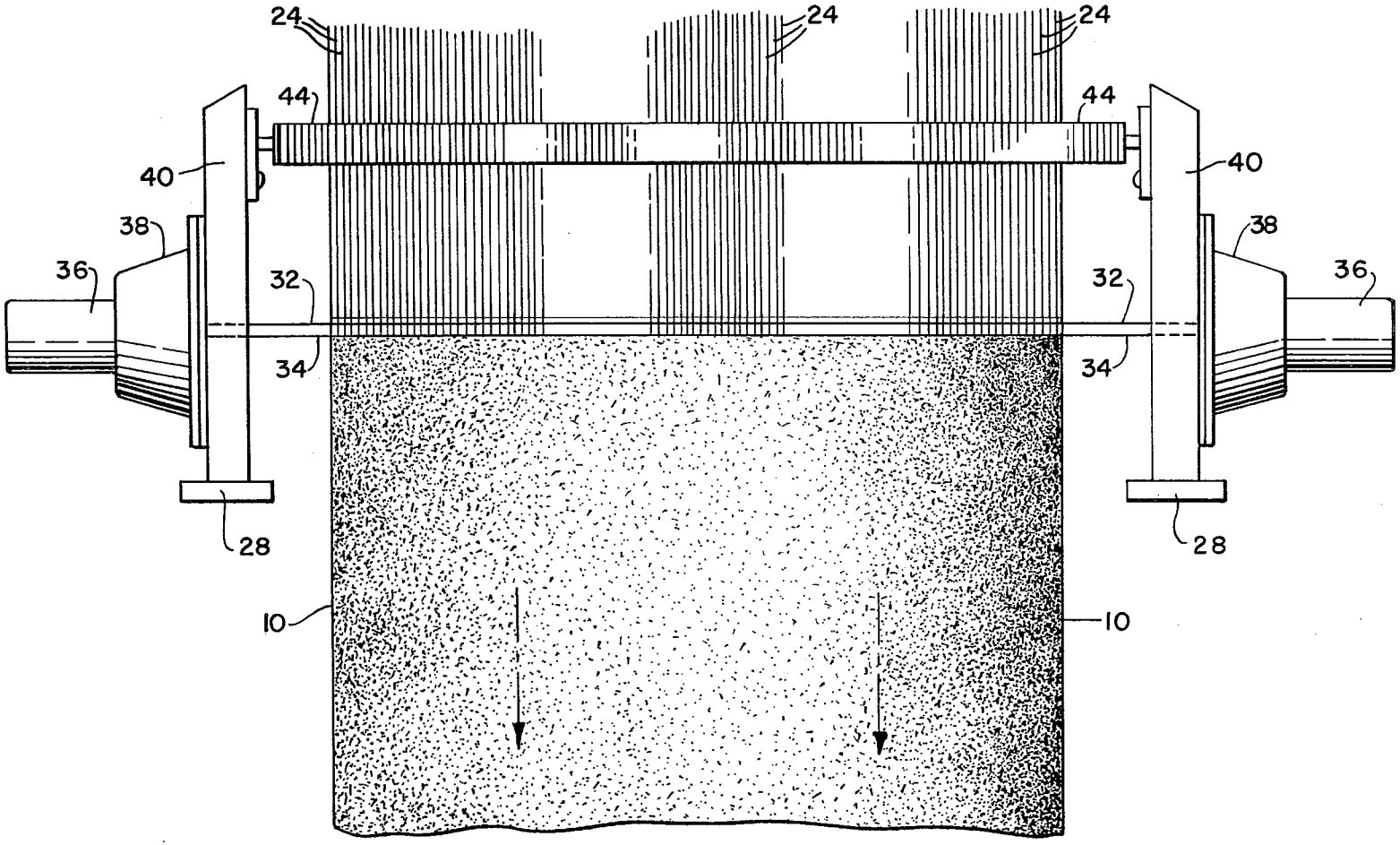
FIG. 2 is a plan view of the portion of the machine mounted on the portion shown in FIG. 1 (if one view is rotated 90° in the horizontal plane) which operates the wires that fold and plant the strands of yarn.

The mechanism used for folding and planting the strands of yarn 24 is generally shown in FIG. 2. This portion of the machine includes the mounting pads 28 which are positioned to be placed upon the mounting pads 30 on the portion of the machine shown in FIG. 1, the two figures coinciding if one of them is rotated 90° in the horizontal plane. These two portions of the machine are designed so that when the mounting pads 28, 30 are properly aligned, the upper portion of the machine shown in FIG. 2 will be in position to perform the folding and planting operation which will now be described in detail.

The folding and planting of the strands of yarn 24 are accomplished by means of a pair of wires 32, 34, which engage the yarn 24 for alternately pushing the strands of yarn 24 intothe PVC on one layer of backing material 10 and then into the PVC on the other layer of backing material 10. The planting takes place a short distance below the upper edge of the well 20.

Each of the wires 32, 34, is tensioned between a pair of wire holders which are mounted for movement along with their moving means in the housings 36, all of which will be described in detail below. The wires both extend across the entire width of the layers of backing material 10 and can be formed of stainless steel and have a diameter of about 1/16th of an inch.

The housings 36 are connected to the machine through the braces 38 which are attached to the vertical support members 40. As will be described in greater detail below, the wire holders move the end portions of the wire 32, 34, through separate, concentric, orbital paths. This orbital movement is then translated into linear movement so that the wires can fold the strands of yarn 24 and plant them in the PVC on the advancing layers of backing material 10.

Figure 3:
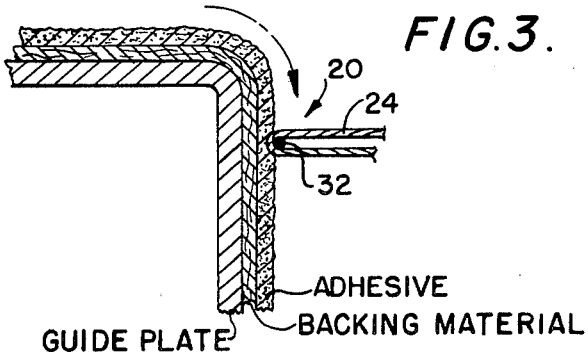
FIG. 3 is an exaggerated sectional view of one of the wires planting a strand of yarn in the adhesive coating on a layer of backing material.

As shown in exaggerated fashion in FIG. 3, the layers of backing material 10, coated with PVC, move horizontally along the guide plates 18 and then vertically into the well 20, in the direction of the arrow. At a short distance below the upper edge of the well 20, the wires 32, 34, push the strands of yarn 24 into the PVC coating. The machine can be adjusted precisely enough so that the wires 32, 34, push the folded ends of the strands of yarn 24 into the PVC a distance sufficient to effect the planting of the strands of yarn without themselves entering the PVC layer. In this way, the wires 32, 34 never come in contact with the PVC and remain clean. The paths along which the portions of the wires 32, 34, that engage the yarn travel will now be described in connection with FIGS. 4–12, the detail in FIG. 3 being eliminated for ease of understanding.

The wire 32 is shown as being solid and the wire 34 hollow so that they can be followed easily, although in realiy both wires would normally be solid. The lines 42 designate the combination of the guide plates 18 over which the layers of the backing material 10 coated with the PVC are advancing step-by-step. The numbers along the vertical portions of the lines 42 indicate the positions where the strands of yarn 24 are planted in the PVC coated layers of backing material 10 while they are stopped between each incremental step during the continuous intermittent advancement.

Figure 4:
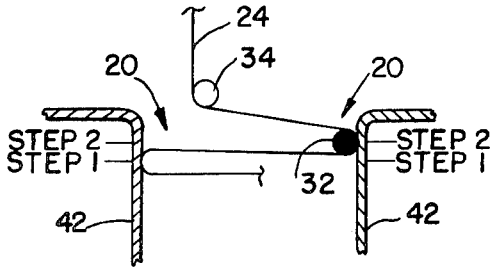
FIGS. 4–12 are schematic views of the wires moving through one folding and planting cycle.

Referring now to FIG. 4, the loop located at Step 1 on the left-hand side of the well 20 has already been planted in the layer of backing material 10. While the layers of backing material 10 are stopped, the wire 32 pushes the strands of yarn 24 into the PVC on the layer of backing material 10 at Step 2 on the right-hand side of the well 20. While the wire 32 is in the position shown in FIG. 4, the wire 34 is poised and ready to push the yarn 24 into the PVC on the left-hand side of the well 20 after the backing layers 10 advance and are stoppped again. After the wire 32 has moved from the position shown in FIG. 4 to the position shown in FIG. 5 to be out of the way of the wire 34 and the yarn 24, the comb 44, shown in FIG. 2, then clamps the strands of yarn 24 and drops them a predetermined distance to create slack in the yarn 24 to enable the yarn 24 to be planted on the left-hand side of the well 20 at Step 3 without pulling out the yarn already planted at the right-hand side of the well 20 at Step 2. This known clamping and dropping mechanism can be replaced by any suitable means that can be synchronized with the movement of the wires and backing material and operate as described. After the slack has been created, the wire 34 is moved from the position shown in FIG. 5, straight down to the position shown in FIG. 6

Figure 6:
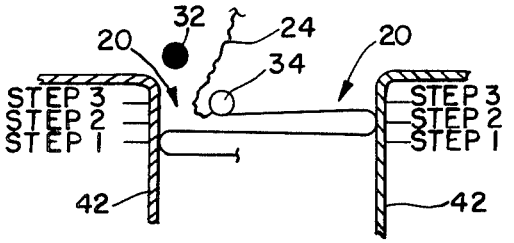
Figure 7:
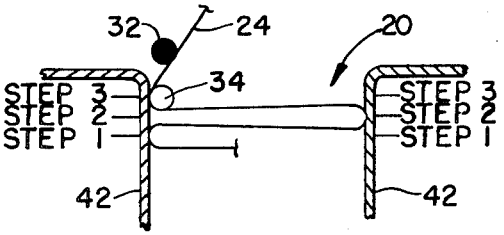

The wire 34 is then moved to the left, from the position shown in FIG. 6 to the position shown in FIG. 7, to push the yarn 24 into the PVC on the layer of backing material 10 at the left-hand side of the well 20 at Step 3. As shown in FIG. 7, the yarn 24 is planted into the backing material 10 after the wire 32 has been moved to a position to escape from the loop formed at Step 3. In this way, the wire which has formed the peceding loop can hold its fold in place in the PVC until the other wire is poised and ready to plant the yarn 24 at the other side of the well 20. Before the other wire creates any tension on the yarn, the first one escapes from where the next loop is to be formed and slack is created in the yarn so that the preceding fold is not pulled out of the PVC. This procedure insures that the folds remain embedded in the PVC without sacrificing operational speed. Now, referring to FIG. 8, as the wire 34 holds the strands of yarn 24 in place to prevent them from pulling out of the PVC, the wire 32 is moved to the right into position shown in FIG. 8, where it is poised and ready to push the strands of yarn 24 into the PVC at Step 4 at the right-hand side of the well 20. Before the layers of backing material 10 are advanced again, the wire 34 moves horizonally toward the right-hand side of the well 20 and then upwardly to the position shown in FIG. 9 to be out of the way of the wire 32 and the next loop. Then, the comb 44 clamps the stands of yarn 24 and drops them a short distance to create the slack shown in FIG. 10.

Figure 10:
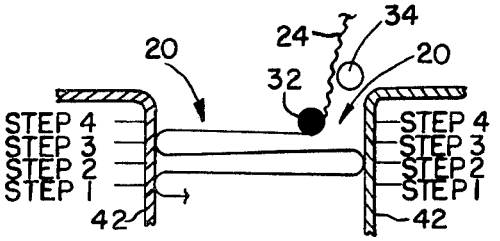
Figure 11:
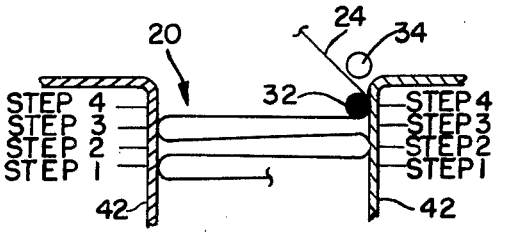
Figure 12:
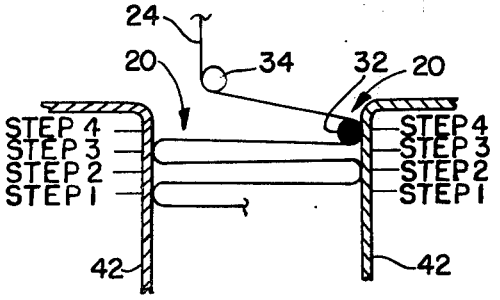

The wire 32 is moved straight down to the position shown in FIG. 10 and the layers of backing material are advanced to the next step. The wire 32 is then moved to the right to plant the strands of yarn 24 into the PVC at the right-hand side of the well 20 at Step 4, as shown in FIG. 11. While the wire 32 holds the strands of yarn 24 in place, the wire 34 moves toward the position shown in FIG. 12. After the wire 34 reaches that position, the wires 32, 34, are in the same positions shown in FIG. 4. Thus, one cycle has been completed of folding and planting the yarn 24 first in the PVC on one side of the well 20 and then in the PVC on the other side of the well 20 to create the accordion-like chains of yarn 20 between the layers of backing material 10.

As shown in FIG. 1, the electromagnets 64 can be positioned behind the vertical portions of the guides 18 on both sides of the well 20 at the exact places where the wires 32, 34, plant the strands of yarn. The electomagnets 64 can be activated during each planting step (see FIGS. 7 and 11) to insure that the yarn is planted at the same place each time.

Figure 13:
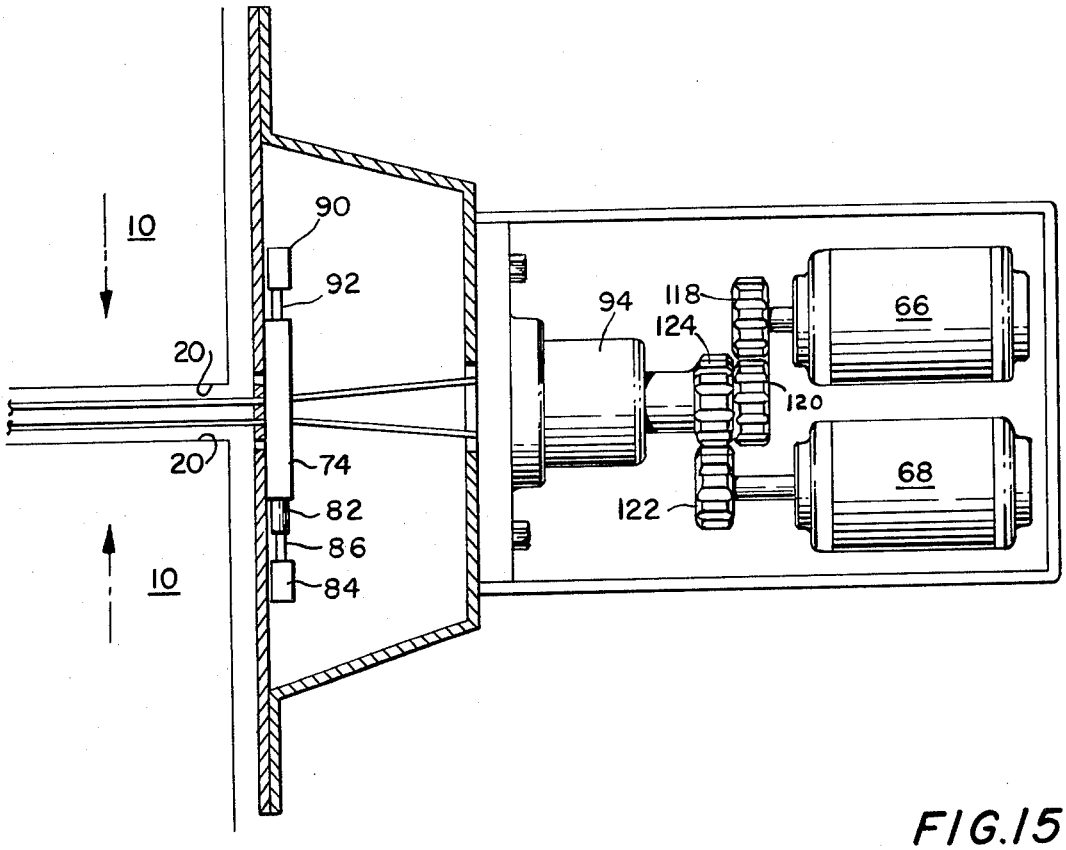
FIG. 13 is a plan view on one side of the machine of the mechanism that moves the wires.

The means for moving the wires 32, 34, along the paths shown in FIGS. 4–12 will now be described in detail. As shown in FIG. 13, which is a top view of the moving mechanism on one side of the machine, the wires 32, 34, are moved by the reversible stepping motors 66, 68, that operate to rotate the wire holders 70, 72 (shown in detail in FIG. 25. For this embodiment of the invention, the portions of the wires 32, 34, that are connected to the 70, 72, holders 70,72, are moved independently along separate, concentric, orbital paths instead of the linear paths described in conjunction with FIGS. 4–12.

The translation from orbital to linear movement is accomplished by means of a cam profile plate 74 located between the wire holders 70, 72, and the well 20 (see FIG. 13). The cam profile plate 74 includes a cam surface 76 that engages and guides the wires 32, 34, and defines the linear paths along which the wires move (see FIGS. 14 and 15). The plate 74 is adjustably movable relative to the well 20 so that the wires 32, 34, can be precisely aligned to move along the linear paths described above.

The movement of the wires 32, 34, along their orbital paths in conjunction with their corresponding linear movement for one cycle of the folding and planting operation is shown schematically in FIGS. 16–24.

Figure 16:
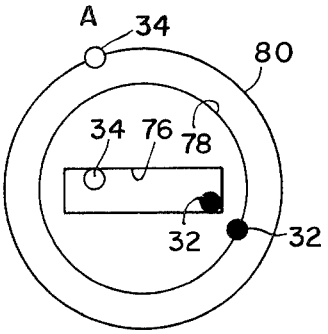
FIGS. 16—24 are schematic views showing the comparative positions of the wires as they move along their orbital and linear paths into the positions shown in FIGS. 4–12, respectively.

In FIG. 16, the portions of the wires 32, 34, shown within the cam surface 76 of the cam profile plate 74 are in the positions shown in FIG. 4. The portions of the wires 32, 34, shown outside the cam surface 76 are the portions connected to the wire holders 70, 72, respectively, and are shown at their respective positions along their concentric orbital paths 78, 80.

Figure 17:
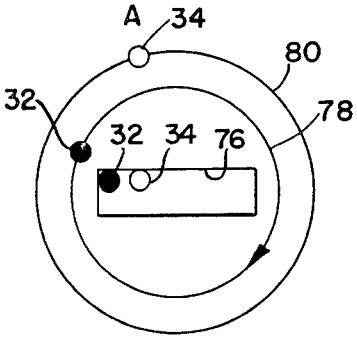

In order to move the wire 32 to the position shown in FIG. 17, the wire holder 70 is rotated to move the wire 32 along the orbital path 78 in the direction of the arrow shown in FIG. 17. When this happens the cam surface 76 guides the wire 32 linearly to the position shown in FIG. 17. The wire 32, 34, are now in the positions shown in FIG. 5.

Figure 18:
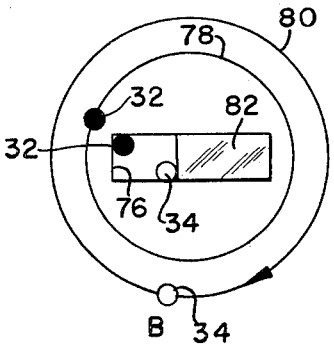
Figure 21:
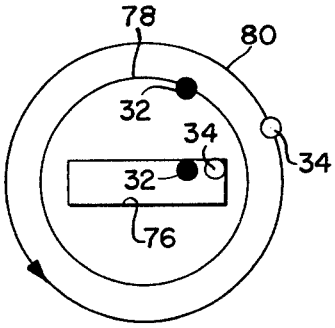
Figure 24:
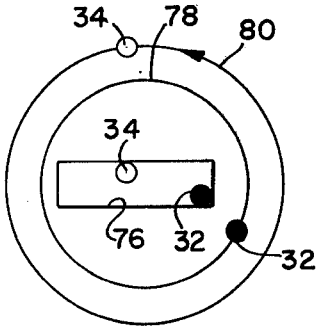

The wire 34 is then moved to the position shown in FIG. 18. This is done by rotating the wire holder 72, which moves the wire 34 along its orbital path 80 in the direction of the arrow shown in FIG. 18. In order to move the wire 34 straight down instead of around the profile of the cam surface 76, a cam plate slide 82 is moved into the position shown in FIG. 18 by means of the solenoid 84 moving the plunger 86 (see FIG. 13). A second slide 88 and plunger 92, moved by the solenoid 90, are provided to function in a similar manner in the other side of the cam surface 76 and will be described in conjunction with FIGS. 22 and 23.

Figure 14:
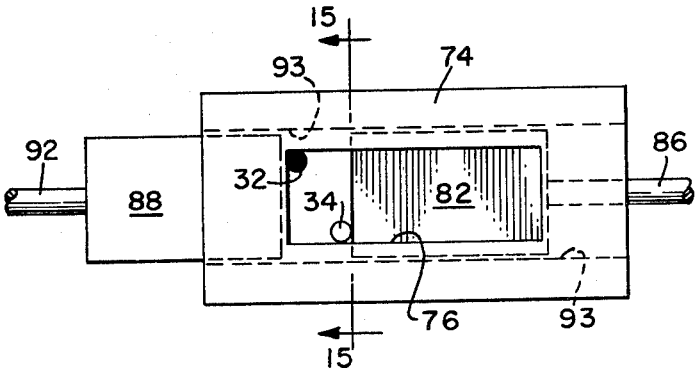
FIG. 14 is a plan view of the cam profile plate that translates the orbital movement of the wires into linear movement.
Figure 15:
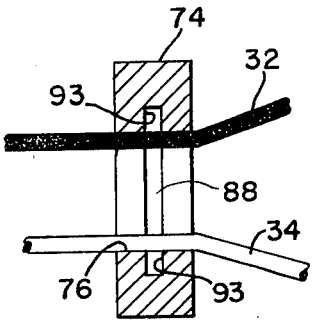
FIG. 15 is a sectional view of the cam profile plate looking in the direction of the line 15—15 as shown in FIG. 14.

The cam profile plate 74 and the slides 82, 88, are shown in detail in FIGS. 14 and 15, where the wires 32, 34, are in the positions shown in FIG. 18. The solenoids 84, 90, are synchronized with the stepping motors that move the wire holders 70, 72, to function as described. The slides 82, 88, move within the groove 93 that is located within the cam profile plate 74, as shown best in FIG. 15.

Figure 19:
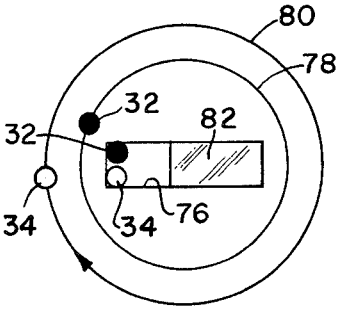

The wire 34 is then moved to the position shown in FIG. 19 to plant the yarn at the left-hand side of the well 20, as shown in FIG. 7. This is done by rotating the wire holder 72, which moves the wire 34 along its orbital path 80 in the direction of the arrow shown in FIG. 19. As this happens the slide 82 is withdrawn from within the cam surface 76 by the solenoid 84 and moved to the right in FIG. 19.

Figure 8:
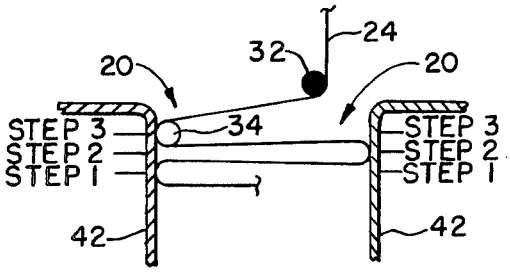
Figure 20:
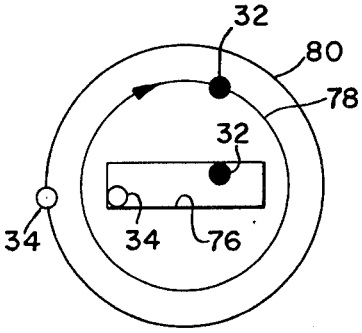
Figure 23:
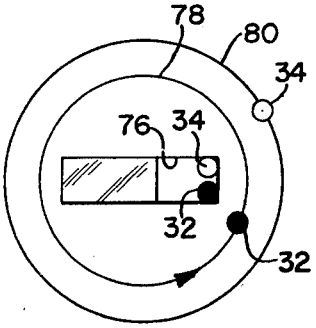

The wire 32 is then moved to the position shown in FIG. 20 by rotating the wire holder 70, which moves the wire 32 along its orbital path 78 in the direction of the arrow shown in FIG. 20, the wires 32, 34, now being in the position shown in FIG. 8. The wire holder 72 then moves the wire 34 to the position shown in FIG. 21, rotating in the direction of the arrow shown in FIG. 21.

Figure 22:
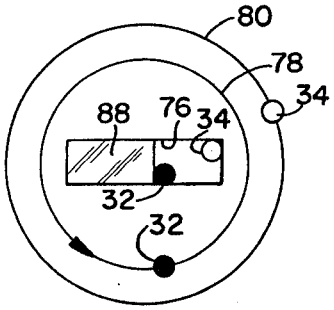

The slide 88 is moved into the position shown in FIG. 22 and the wire 32 is moved straight down by the wire holder 70 similar to the way the wire 34 was moved down to the position folding in FIG. 18. The wires 32, 34, are now in the position shown in FIG. 10. The wire 32 is then moved to the right to the position shown in FIG. 23 to plant the yarn at the right-hand side of the well 20 as shown in FIG. 11. The slide 88 is then withdrawn from within the cam surface 76 by means of the solenoid 90. The wire 34 is then moved to the position shown in FIG. 24. The wires 32, 34, are then in the same positions shown in FIG. 16 and one cycle of the foldng and planting operation has been completed.

Alternative to the operation just described, the slides 82, 88, ca be controlled by appropriately designed and known solenoids or other moving means to move each of the slides into a third position. This third position would be a short distance inside the vertical dimension of the cam surface 76 so that instead of the wires 32, 34, moving directly to the positions shown in FIGS. 17 and 21, respectively, they will engage a slide and move vertically without engaging the cam surface 76. In this way, the wires will move vertically at a short distance from the cam surface 76 and the PVC coating so that if there are any irregularities in the PVC coating the wires will not touch the PVC while they are moving.

Figure 5:
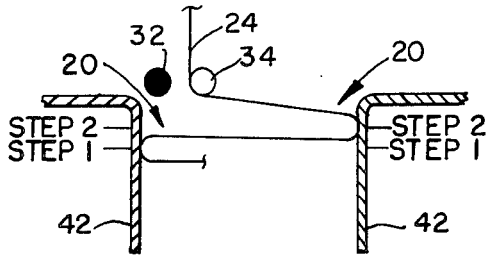
Figure 9:
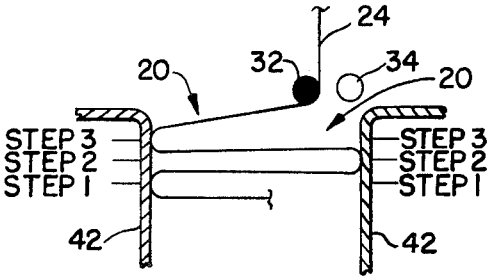

After the wires 32, 34, move to their vertical positions, the slides 88, 82, will be moved to their positions outside the area of the cam surface 76, so that the slides will not interfere with the next planting step. When the slides are so moved, the wires will move automatically to the positions shown in FIGS. 17 and 21 because of the tension in the wires created by the springs described below. The wires can be positioned, as shown in FIGS. 5 and 9, so that at the limit of their vertical movement they will be above the horizontal portion of the guides 18. Thus, when the slides are moved out of the cam surface 76, the wires will not touch the PVC when they move to engage the cam surface 76.

Figure 25:
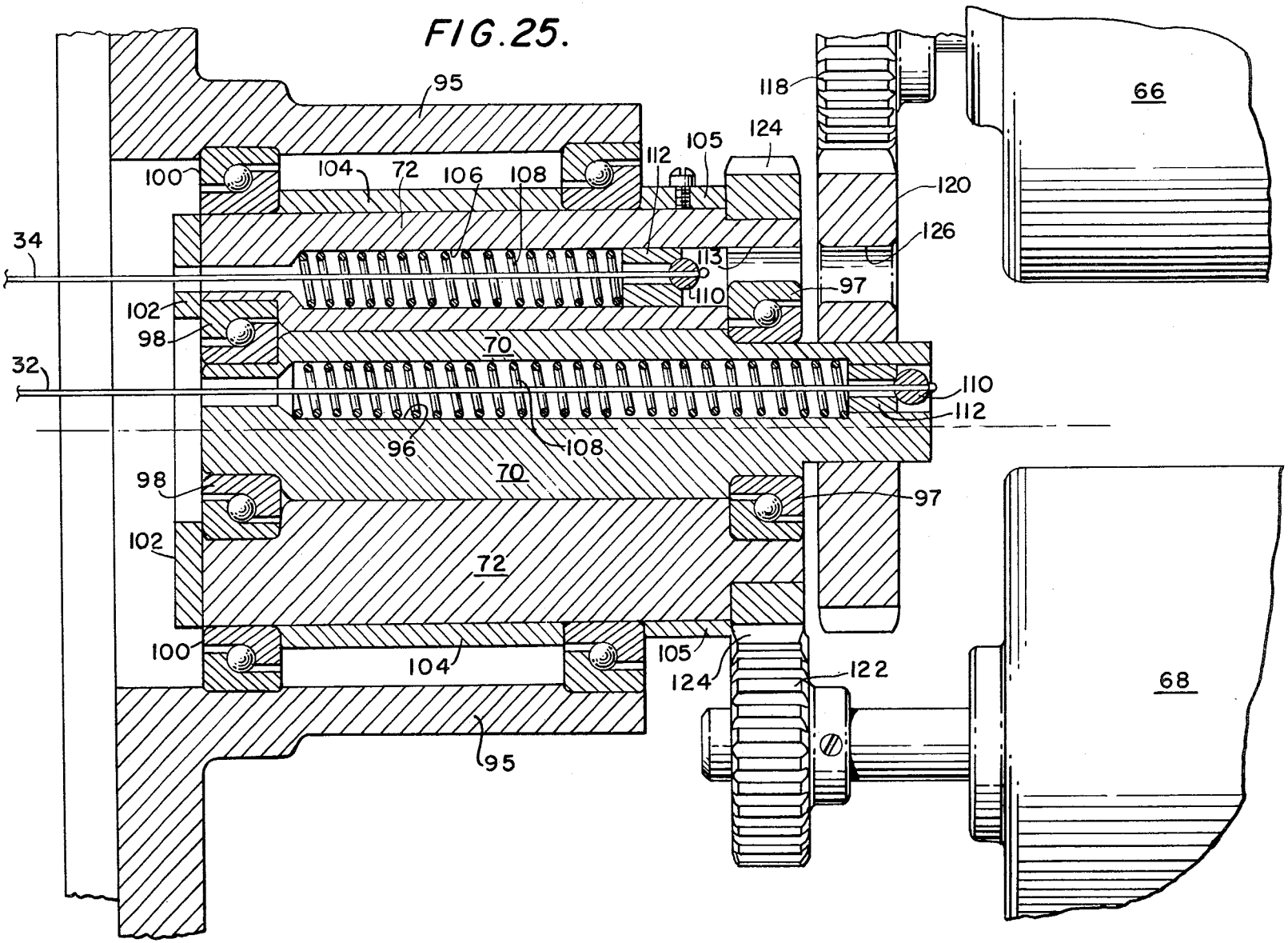
FIG. 25 is a sectional view of the wire holders that move the wires along their orbital paths.

FIG. 25 shows in detail the mechanism used to move the wires 32, 34, and is a section view of the hub 94 shown in FIG. 13, along with other components of the mechanism.

The hub 94 includes a housing 95 in which the annular wire holders 70, 72 are mounted for rotation. The wire holder 70 is nested for independent rotation within the wire holder 72. The wire holde 70 has a chamber 96 extending axially through it, where the wire 32 is connected, but the chamber 96 is off center so that when the wire holder 70 rotates the portion of the wire 32 in the wire holder 70 will move along the orbital path 78.

The wire holder 72 is cylindrical in shape and designed to fit over the wire holder 70. The bearings 97, 98, are disposed between the wire holders 70, 72, so that they can rotate independent of each other. The bearings 98 are prevented from moving laterally to the left by the retainer plate 102. The wire holder 72 is, in turn, rotatably connected to the inner surface of the housing 95 through the bearings 100, which are held in place by the spacer 104 and the collar 105. The bearings 97, 98 and 100, are all combined roller and thrust bearings to effectively combat the tendency of the wire holders on opposite sides of the well 20 to move toward each other in addition to allowing their rotational movement. The wire holder 72 includes the chamber 106 extending axially through it where the wire 34 is connected. Thus, as the wire holder 72 rotates, the portion of the wire 34 in the wire holder 72 will move along the orbital path 80.

The wires 32, 34 are tensioned between their respective pairs of wire holders by a helical spring 108 located in the chambers 96, 106, preferably on one side of the machine. The ends of the wires 32, 34, are connected to the balls 110 that are clamped onto the ends of each wire, the balls 110 being held in place on the outer edge of the sliders 112. The connection between the wires and the balls in such that the wires can easily be replaced when needed. With this type of arrangement, the combined orbital and linear movement of the wires 32, 34, is made possible because when the length of the wires between the cam surface and their holders tends to increase due to the difference in shape between the cam surface and the orbital paths of the wire ends, the sliders 112 will move inwardly causing the springs 108 to compress. In addition, when the length tends to decrease the springs 108 will cause the sliders 112 to move outwardly and maintain a predetermined minimum tension in the wires. An opening 113 is provided in the wire holder 72 so that the wire 34 can easily be replaced.

The wire holders 70, 72, are rotated by a pair of conventional, reversible, stepping motors 66, 68. The stepping motor 66 drives the gear 118 which in turn drives the gear 120 that is connected to the wire holder 70, and the stepping motor 68 drives the gear 122 which drives the gear 124 that is connected to the wire holder 72. For the arrangement shown in FIG. 25, the gear 120 includes an opening 126 so that the wire 34 can be replaced. The stepping motors 66, 68, are programmed in a known way to rotate the wire holders 70, 72, in the sequence described in conjunction with FIGS. 16–24. Although the gears 118, 122, are shown in FIG. 25 to be approximately one-half the diameter of the gears 120, 124, other suitable ratios can be used. The stepping motors 66, 68, are synchronized with each other, with the solenoids 84, 90, and with the stepping motors that are used to advance the layers of backing material 10 to accomplish the results discussed above.

Thus, there is provided in accordance with the invention a mechanism tht is capable of folding and planting strands of yarn in the PVC coating on advancing lyers of backing material much more quickly and efficiently than prior art devices. The embodiment of the invention described above is intended to be merely exemplary, and those skilled in the art will be able to make modifications and variations to it without departing from the spirit and scope of the appended claims. All such modifications and variations are contemplated as falling within the scope of the claims.

I claim:

1. A method for engaging and folding a plurality of strands of flexible material into a plurality of series of loops between first and second opposing surfaces, comprising the steps of:

a. moving a first elongated member to engage said strands and move them against the first surface;
b. moving the first elongated member out of the area of the loop that will be formed when the second elongated member moves the strands against the second surface;
c. creating slack in said strands;
d. moving the second elongated member to move the strands against the second surface to form a loop;
e. moving the second elongated member out of the area of the loop that will be formed when the first elongated member moves the strands against the first surface;
f. creating slack in said strands;
g. moving the first elongated member to move the strands against the first surface to form a loop and
h. for steps (a), (b), (d), (e) and (g), rotating said elongated members at the ends thereof and translating the rotational movement into non-rotational movement in the portion of the elongated members that engage the strands along at least a portion of the movement of the elongated members.

2. The method in claim 1, and further including the step of moving the second elongated member to engage the strands at a distance away from the second surface while the first elongated member holds the strands against the first surface, between steps (a) and (b).

3. The method in claim 1, and further including the step of moving the first elongated member to engage the strands at a distance away from the first surface while the second elongated member holds the strands against the second surface.

4. The method in claim 1, wherein steps (a), (d) and (g) include planting the strands in a layer of adhesive.

5. The method in claim 1, wherein steps (c) and (f) include clamping and lowering said strands a predetermined distance.

6. The method in claim 1, wherein steps (a), (d) and (g) include moving the elongated members horizontally.

7. A driving and guiding mechanism for moving two elongated flexible members along separate predetermined paths for alternately moving said members back and forth across a plurality of strands of flexible material for engaging and folding said strands to form a series of loops from each strand, comprising holding means for holding both ends of each elongated member so that the members will extend across the area covered by the strands, drive means for moving said holding means so that the portions of each member outside the area covered by the strand will be moved along first predetermined orbital paths, guide means for guiding the portion of each member extending across the area covered by the strands along second predetermined non-orbital paths through at least a part of the movement of the elongated members as they engage and fold the strands to form the series of loops.

8. The driving and guiding mechanism in claim 7, wherein the non-orbital movement is linear.

9. The driving and guiding mechanism in claim 7 wherein holding said means includes a rotatably movable member capable of being connected to each elongated member.

10. The driving and guiding mechanism in claim 9, wherein said movable members are coaxial.

11. The driving and guiding mechanism in claim 9, wherein said movable members are nested one in the other.

12. The driving and guiding mechanism in claim 11, wherein said holding means includes bearing means disposed between said nested members for enabling them to rotate independently of each other.

13. The driving and guiding mechanism in claim 12, whrein said bearing means includes a plurality of combined roller and thrust bearings.

14. The driving and guiding mechanism in claim 9, wherein said means for holding includes spring means capable of being connected to each elongated member.

15. The driving and guiding mechanism in claim 14, wherein said spring means includes a coil spring capable of being connected to each elongated member.

16. The driving and guiding mechanism in claim 15, wherein each movable member includes a chamber therein each of said coil springs being located in a chamber.

17. The driving and guiding mechanism in claim 16, wherein said means for holding includes a slider capable of being connected to the end of each elongated member, each slider being slidingly movable in a chamber and engaging the outer end of the coil spring located in said chamber.

18. The driving and guiding mechanism in claim 17, wherein said chambers are coaxial.

19. The driving and guiding mechanism in claim 17, wherein each of said sliders includes an opening therethrough, said elongated members being capable of being connected to a holder larger than said opening and positioned on the outer end of the corresponding slider.

20. The driving and guiding mechanism in claim 9, wherein said elongated members are wires.

21. The driving and guiding mechanism in claim 8, wherein said translating means includes a first cam surface between said movable members and said strands, said first cam surface being shaped and dimensioned to engage and guide the wires along their linear paths.

22. The driving and guiding mechanism in claim 21, wherein said translating means includes a cam plate having an opening therein defined by said first cam surface.

23. The driving and guiding mechanism in claim 22, wherein said first cam surface is rectangular in shape.

24. The driving and guiding mechanism in claim 23, wherein said wires are connected to said movable members and extend parallel to each other, said first cam surface will be totally within the rotational path of each wire in the plane perpendicular to said wires.

25. The driving and guiding mechanism in claim 9, wherein said means for moving includes a reversible stepping motor connected to each of said movable members.

26. The driving and guiding mechanism in claim 25, wherein a first gear is connected to each stepping motor and a second gear is connected to each movable member, said first and second gears meshing with each other.

* * * * *

UNITED STATES PATENT OFFICE
CERTIFICATE OF CORRECTION

Patent No. 4,022,642 Dated May 10, 1977

Inventor(s) MARTIN L. ABEL

It is certified that error appears in the above-identified patent and that said Letters Patent are hereby corrected as shown below:

Col. 1, line 16, before "row" insert -- a --.

Col. 2, line 2, "to slow" should read -- too slow --;
line 14, "porvided" should read -- provided --;
line 24, "enogh" should read -- enough --;
line 46, after "A cam" insert -- profile --; and
line 64, "hold" should read -- held --.

Col. 3, line 53, after "by" insert -- the --.

Col. 4, line 22, "fom" should read -- form --;
line 42, "intothe" should read -- into the --; and
line 57, "wire" should read -- wires --.

Col. 5, line 12, "realiy" should read -- reality --; and
line 53, "peceding" should read -- preceding --.

Col. 6, line 4, "stands" should read -- strands --;
line 24, "electo-"should read -- electro- --;
line 37, delete "70, 72" first occurrence, and add -- wire --; and
line 67, "The wire" should read -- The wires --.

Col. 7, line 40, delete "folding" and insert -- shown --;
line 49, "foldng" should read -- folding --; and
line 51, "ca" should read -- can --.

UNITED STATES PATENT OFFICE

CERTIFICATE OF CORRECTION

Patent No. 4,022,642 Dated May 10, 1977

Inventor(s) MARTIN L. ABEL

It is certified that error appears in the above-identified patent and that said Letters Patent are hereby corrected as shown below:

Col. 8, line 15, "wire holde" (second occurrence) should read -- wire holder --.

Col. 9, line 12, "tht" should read -- that --; and
line 13, "lyers" should read -- layers --.

Col. 10, line 19, "holding said" should read -- said holding --;
line 33, "whrein" should read -- wherein --.

Col. 11, line 6, after "wherein" insert -- when --.

Signed and Sealed this

*Fifteenth* Day of *November 1977*

[SEAL]

*Attest:*

RUTH C. MASON
*Attesting Officer*

LUTRELLE F. PARKER
*Acting Commissioner of Patents and Trademarks*